United States Patent [19]

Morris

[11] 3,931,849

[45] Jan. 13, 1976

[54] MECHANISM FOR OPERATING THE LOCKING MEANS FOR THE CHILL PLATE OF A RIGID STARTER BAR

[75] Inventor: Thomas A. Morris, Jefferson Borough, Pa.

[73] Assignee: United States Steel Corporation, Pittsburgh, Pa.

[22] Filed: Aug. 20, 1974

[21] Appl. No.: 498,910

[52] U.S. Cl. ..... 164/274

[51] Int. Cl.[2] ..... B22D 11/08

[58] Field of Search ..... 164/274, 82, 282, 283

[56] References Cited

UNITED STATES PATENTS

| | | | |
|---|---|---|---|
| 3,338,297 | 8/1967 | Foldessy | 164/282 X |
| 3,448,789 | 6/1969 | Gallucci | 164/274 |
| 3,520,351 | 7/1970 | Rankin | 164/82 X |
| 3,528,486 | 9/1970 | Golde | 164/274 |

FOREIGN PATENTS OR APPLICATIONS

| | | | |
|---|---|---|---|
| 1,026,420 | 4/1966 | United Kingdom | 164/282 |
| 1,157,866 | 7/1969 | United Kingdom | 164/274 |

*Primary Examiner*—Francis S. Husar
*Assistant Examiner*—John S. Brown
*Attorney, Agent, or Firm*—Walter P. Wood

[57] ABSTRACT

A method and mechanism for operating the locking means for the chill plate of a rigid starter bar in a continuous-casting machine. The mechanism enables the starter bar to remain in contact with its hoist throughout the operating cycle and assures that the leading end of a casting always is at the same level when the starter bar is disconnected, and also assures that the chill plate is properly locked to the starter bar when the latter is lifted into position to begin a cast.

4 Claims, 7 Drawing Figures

10
12
13
14
15
16
17
21
27
29
30
31
34
II
II 10
12
13
19
20
21
22
23
27
29
30
31
32
33
34
35
36

10
12
13
19
20
21
22
23
27
29
30
31
32
33
34
35
36

MECHANISM FOR OPERATING THE LOCKING MEANS FOR THE CHILL PLATE OF A RIGID STARTER BAR

This invention relates to an improved method and mechanism for operating the locking means for the chill plate of a rigid starter bar in a continuous-casting machine.

In continuous-casting machines which utilize a rigid starter bar, conventional practice is to catch the descending bar in a basket hoist as it is disconnected from the leading end of the casting and lower it out of the way. Before the next cast begins, a detachable chill plate is installed on the upper end of the bar, and the hoist and bar are lifted to position the chill plate within the mold thereabove. When the starter bar subsequently is disconnected, the chill plate stays with the casting. Reference can be made to Gallucci U.S. Pat. No. 3,448,789 of common ownership for a showing of a rigid starter bar, disconnect means, and a basket hoist of the type to which the present invention relates and over which the present invention is an improvement.

In the known apparatus, such as the Gallucci patent shows, the locking means for the chill plate includes a rod which extends through a vertical passage in the body of the starter bar and which carries a plunger at its lower end. Soon after the beginning of a cast, as the descending starter bar reaches the basket hoist, the plunger contacts the bottom of the hoist and pushes the rod upwardly relative to the body of the bar. The upper end of the rod is connected to a linkage at the top of the body, which linkage acts to release the chill plate on such contact.

The known operating mechanism for the locking means has certain disadvantages. The starter bar does not remain in contact with the hoist throughout the operating cycle. When the starter bar is lifted at the beginning of a cast, it is picked up by power driven pinch rolls of the casting machine. The pinch rolls lift the bar off the hoist and propel it to its final position for beginning a cast. If for any reason the starter bar is allowed to drop, the parts may be damaged. Modern low head casting machines have only a single set of pinch rolls. If these are opened inadvertently, the bar of course drops. Another difficulty is that the hoist is not necessarily always at the same height when the descending starter bar contacts it. Hence the level of the leading end of the casting at the moment the starter bar is disconnected varies from cast to cast. This is of little consequence in some installations which have two or more sets of power driven pinch rolls engaging the starter bar at spaced-apart levels. In such installations it is necessary only that the leading end of the casting lies somewhere between the sets of pinch rolls at the moment of disconnect. Low-head installations have only a single set of pinch rolls and operate properly only if the leading end of the casting always is at the same level within the pinch rolls when the starter bar is disconnected.

An earlier invention described and claimed in Cuscino application Ser. No. 494,244, filed Aug. 2, 1974, of common ownership, has overcome these difficulties. In the Cuscino invention a single fixed cam track is mounted adjacent the path of the basket hoist, and a cooperating actuating lever for the chill plate locking means is pivoted to the hoist. Hence it is unnecessary to lift the starter bar off the hoist to operate the locking means, and the bar can remain on the hoist throughout the operating cycle. When the hoist descends, the actuating lever engages the cam always at the same height, whereby the leading end of the casting always is at the same level when the starter bar is disconnected.

There is a further difficulty which the Cuscino invention does not overcome. In the known practice the chill plate merely rests on top of the starter bar through most of the ascent of the bar to begin a cast. The chill plate is not locked in place until the pinch rolls engage the starter bar and lift it off the hoist in the Gallucci patent, or until the actuating lever used in the Cuscino invention clears the cam track. Only then can the plunger and rod gravitate downwardly relative to the body of the bar and lock the chill plate to the bar. Hence the chill plate can be dislodged from the position in which the locking means can engage it and lock it in place.

An object of my invention is to provide an improved method and mechanism for operating the locking means for the chill plate of a rigid starter bar, in which I not only maintain the bar in contact with the hoist throughout the operating cycle and assure that the leading end of the casting is at the proper level when the starter bar is disconnected, but also I lock the chill plate to the bar almost as soon as the basket hoist commences to ascend to begin a cast.

A more specific object is to provide an improved method and mechanism for accomplishing the foregoing object in which I use upper and lower fixed cams and a specially designed cooperating actuating lever pivoted to the hoist, said lever acting to lock the chill plate to the starter bar when it clears the lower cam as the hoist ascends, and acting to disconnect the starter bar from the chill plate and casting when it engages the upper cam as the hoist descends.

Figure 1:
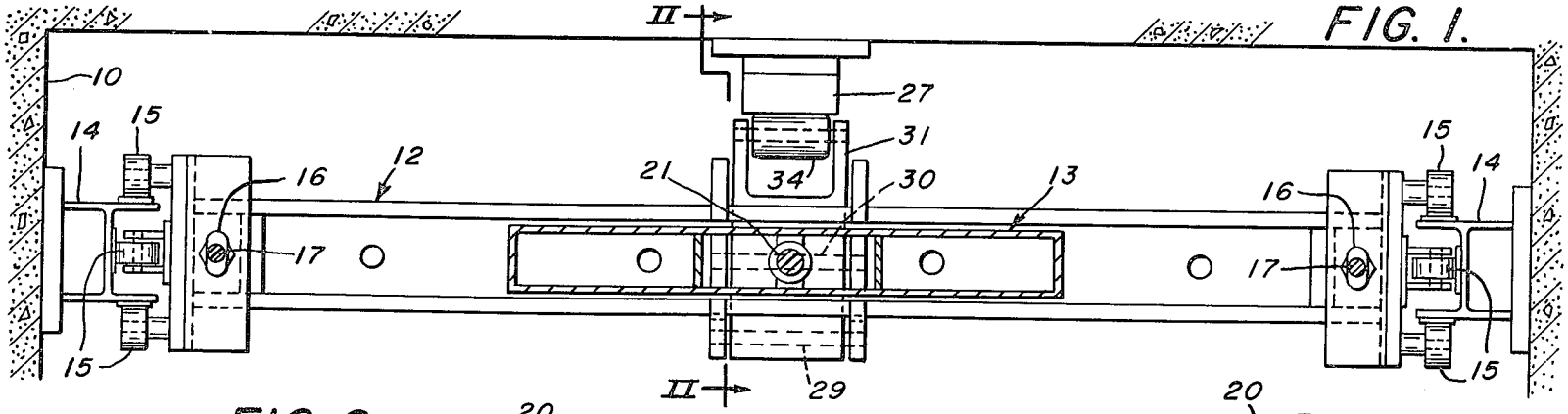
FIG. 1 is a top plan view of a basket hoist and starter-bar equipped with an operating mechanism constructed in accordance with my invention.

FIG. 1 shows in plan a portion of a pit 10 which is located beneath a continuous-casting machine and receives a basket hoist 12 carrying a starter bar 13. The walls at two opposed faces of the pit carry guides 14. Rollers 15 are journaled to the hoist at its ends and ride against these guides. The upper face of hoist has eye bolts 16 or equivalent adjacent each end to which ropes 17 are attached for lifting and lowering the hoist and starter bar.

Figure 3:
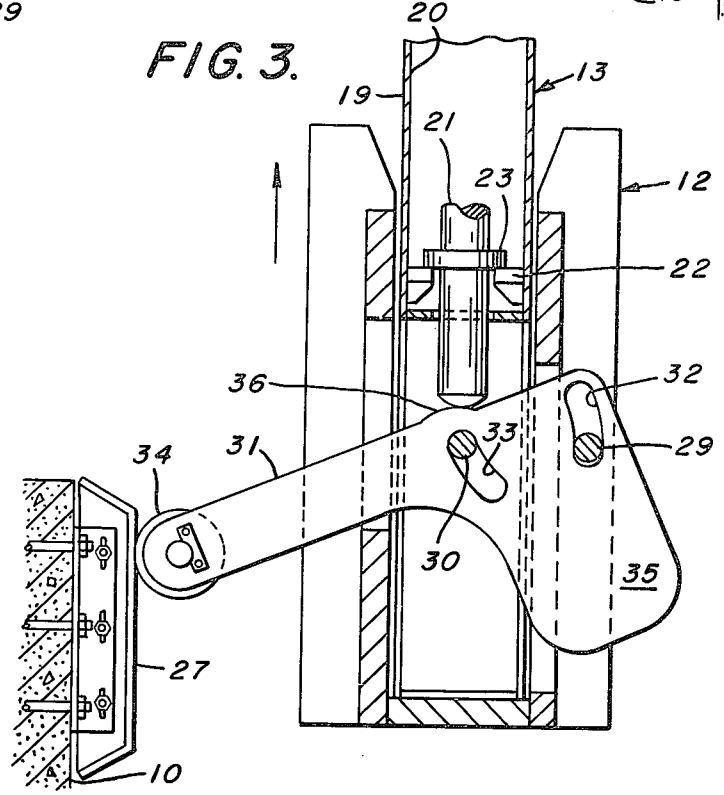
FIG. 3 is a view similar to FIG. 2, but showing the position of parts as the hoist passes the upper cam during its ascent.
Figure 2:
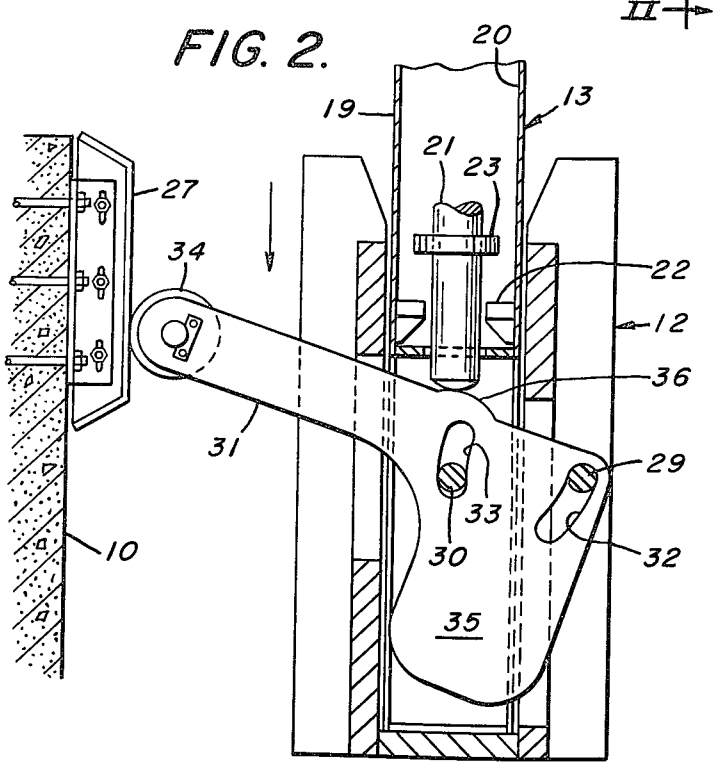
FIG. 2 is a vertical sectional view on line II—II of FIG. 1 showing the position of parts as the hoist passes the upper cam during its descent.

As shown in FIGS. 2 and 3, the starter bar 13 includes a body 19 which has a vertical passage 20. A rod 21, which forms part of the locking means, is housed for vertical movement within this passage. The body 19 carries a stop 22 within passage 20 and through which rod 21 extends. The rod carries a cooperating stop 23 situated above stop 22. The upper end of the starter bar has a linkage to which rod 21 is connected for locking a chill plate 24 (shown in the diagrammatic views of FIGS. 4 to 7) to the bar. Preferably the linkage is of similar construction to that shown in the aforementioned Gallucci patent; hence the showing is not repeated. When rod 21 is in a position such that stop 23 contacts stop 22 (FIG. 3), the chill plate 24 is locked to the starter bar. When the rod moves relatively upward from this position (FIG. 2), the chill plate is released and can be freely installed or removed.

In accordance with my invention, the wall at the broad face of pit 10 carries upper and lower fixed cams 27 and 28, best shown in the diagrammatic views of FIGS. 4 to 7. The cams normally are stationary, but the position of at least the upper cam can be adjusted vertically. The hoist 12 has two fixed pivot pins 29 and 30, the axes of which lie in the same horizontal plane below the lower end of rod 21 (FIGS. 1, 2 and 3). An actuating lever 31 has arcuate slots 32 and 33 which receive the respective pins 29 and 30. A roller 34 is journaled to free end of lever 31 and is cooperable with cams 27 and 28. Lever 31 has an integral depending counterweight 35 which balances the lever so that it normally assumes a horizontal or mid position. The upper edge of the lever has a rounded segment 36 against which the lower end of rod 21 bears.

As long as the starter bar is resting on the hoist and lever 31 is in its normal or mid position, rod 21 is in its lowermost position in which stop 23 abuts stop 22. As FIG. 2 shows, when hoist 12 is descending and roller 34 engages either cam 27 or 28, lever 31 pivots clockwise about pin 29 from its mid position. Thus the lever raises rod 21 relative to the starter bar body 19. This action releases the locking means at the top of the bar, as already explained. As FIG. 3 shows, when hoist 12 is ascending and roller 34 engages the upper cam 27, lever 31 pivots counterclockwise about pin 30 from its mid position. This action enables the lever to clear the cam without moving rod 21 relative to the body 19.

As shown in the diagrammatic views of FIGS. 4 to 7, a pair of sheaves 39 are journaled to a suitable support above pit 10. The ropes 17 of the hoist 12 extend over the sheaves and down to the basket. A chill-plate maintenance platform 40 is situated above pit 10 adjacent the position which the upper end of the starter bar 13 occupies when the bar is in its lowermost position in the pit. Above the platform are the various rolls 41 of the casting machine, including power driven pinch rolls 42 and a switch section 43. Above the rolls is an open-ended mold 44. The casting machine itself can be conventional and hence is not shown in detail. FIGS. 4 to 7 also illustrate my operating method.

Figure 4:
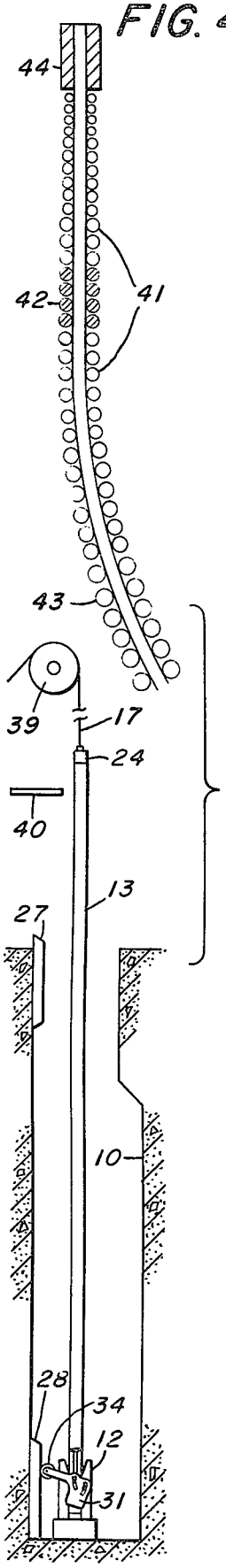
FIG. 4 is a diagrammatic side elevational view showing the relation of parts with the basket hoist fully lowered before a cast is to begin.

FIG. 4 shows the hoist 12 and starter bar 13 in their lowermost position, which they occupy while a casting operation is taking place. Roller 34 engages the lower cam 28, whereby lever 31 is rotated clockwise from its mid position and the locking mechanism at the upper end of the bar is released. An individual standing on platform 40 can install a chill plate 24 on the bar.

Figure 5:
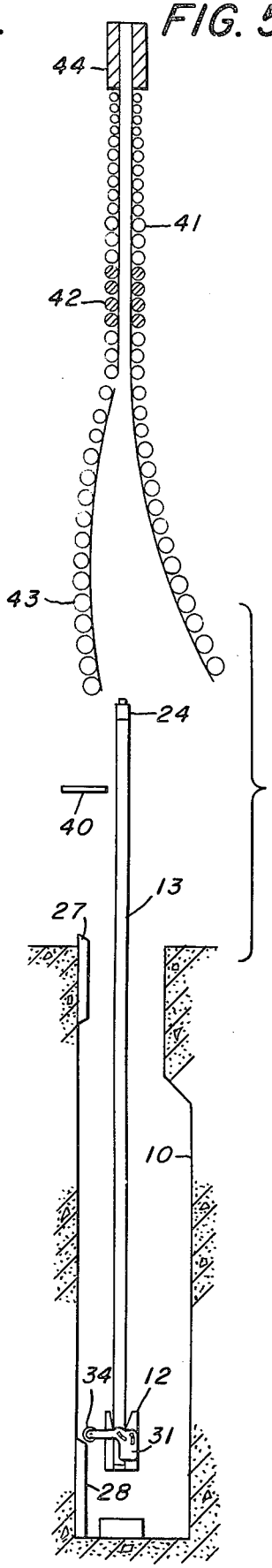
FIG. 5 is a view similar to FIG. 4 but showing the actuating lever clearing the lower cam.

FIG. 5 shows the hoist and starter bar ascending to start a cast. Roller 34 has cleared the lower cam 28, whereby lever 31 has returned to its mid position. The locking mechanism has locked the chill plate 24 to the top of the bar. The chill plate still is visible to the individual standing on platform 40 and he can make certain that the chill plate has been locked properly to the bar. The switch section 43 is open to allow the starter bar to pass on its way to the mold 44.

Figure 6:
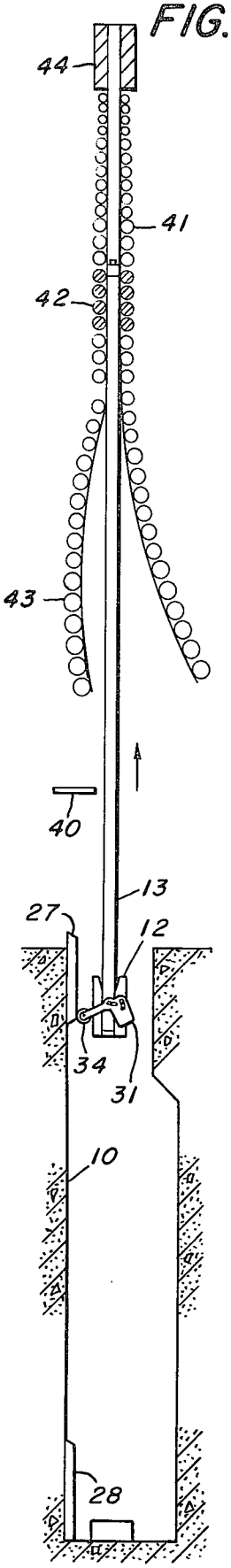
FIG. 6 is another similar view showing the actuating lever engaging the upper cam during ascent of the hoist.

FIG. 6 shows the hoist and starter bar continuing to ascend. Roller 34 has engaged the upper cam 27, whereby lever 31 has rotated counterclockwise from its mid position. As already explained, such rotation does not impart relative movement to rod 21, but enables the roller to clear the upper cam. As soon as the roller clears the cam, the lever returns to its mid position while the hoist and starter bar continue to ascend to their final positions for beginning the cast (not shown). In normal operation, the starter bar need not be lifted free of the hoist, but may remain in contact so that it does not drop and damage the parts if the pinch rolls 42 are opened inadvertently.

Figure 7:
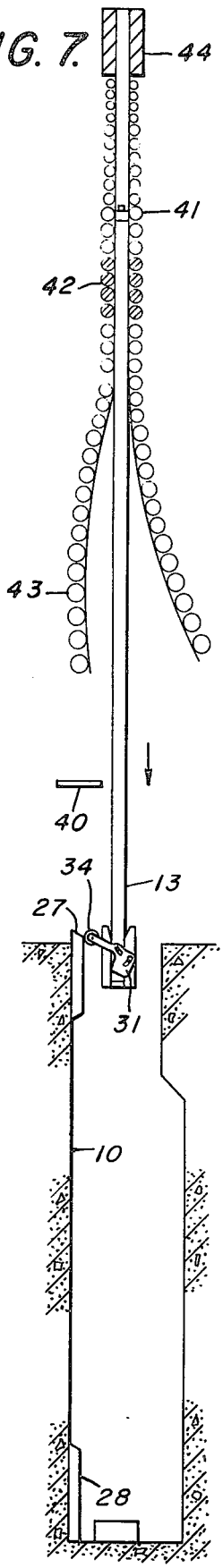
FIG. 7 is another similar view showing the actuating lever engaging the upper cam during descent of the hoist.

FIG. 7 shows the hoist and starter bar descending. Roller 34 has engaged the upper cam 27, whereby lever 31 has rotated clockwise from its mid position. This disconnects the chill plate from the starter bar. Continued descent of the hoist returns the parts to the position shown in FIG. 4.

From the foregoing description, it is seen that my invention affords a simple method and mechanism for operating a rigid starter bar and overcoming problems encountered with previous arrangements. The invention not only assures that the starter bar remains in contact with the hoist throughout the operating cycle and that the leading end of the casting is at the proper level at the moment the starter bar is disconnected, but also assures that the chill plate is locked to the starter bar while the latter is lifted and cannot be dislodged unintentionally.

I claim:

1. In a combination which includes a rigid starter bar, a chill plate, a vertically movable hoist for carrying said bar, and means for receiving said hoist and bar when lowered, said bar having locking means for said plate movable between released and locked positions, an improved mechanism for operating said locking means, said mechanism comprising actuating means carried by said hoist and engaging said locking means, a first means on said receiving means cooperable with said actuating means for moving said locking means to its locked position when said bar and hoist ascend from their lowermost position, and a second means on said receiving means spaced above the first-named means thereon cooperable with said actuating means for moving said locking means to its released position when said hoist and said bar descend to disconnect said bar from said plate, said actuating means clearing the second-named means on said receiving means during ascent of said hoist without changing the position of said locking means.

2. A combination as defined in claim 1 in which said actuating means includes a lever pivoted to said hoist and normally occupying a mid position, said lever operating said locking means when rotated in one direction from its mid position, but being rotatable in the other direction from its mid position without changing the position of said locking means.

3. A combination as defined in claim 2 in which said first and second means on said receiving means includes upper and lower cams, and further comprising means on said lever engageable with said cams.

4. A combination as defined in claim 3 in which said hoist carries a pair of horizontally spaced pivot pins and said lever has a pair of arcuate slots receiving the respective pins, said lever being balanced normally to move to its mid position, but rotating about one of said pins when the means on said lever engages either of said cams in ascending, and about the other pin in descending.

* * * * *